United States Patent [19]

Andersen et al.

[11] Patent Number: 4,573,874

[45] Date of Patent: Mar. 4, 1986

[54] SPRING BIASED BAYONET COUPLING FOR FAN BLADES

[75] Inventors: Steen H. Andersen, Naestved; Bendt O. Pedersen, Karrebaeksminde, both of Denmark

[73] Assignee: Nordisk Ventilator Co. A/S, Naestved, Denmark

[21] Appl. No.: 657,902

[22] Filed: Oct. 5, 1984

[30] Foreign Application Priority Data

Oct. 7, 1983 [DK] Denmark ..... 4631/83

[51] Int. Cl.[4] ..... F04D 29/36

[52] U.S. Cl. ..... 416/157 R; 416/167; 416/205; 416/209

[58] Field of Search ..... 416/147, 157 R, 157 C, 416/167, 168 R, 168 A, 205, 246, 204 R, 209, 239

[56] References Cited

U.S. PATENT DOCUMENTS

| | | | |
|---|---|---|---|
| 3,810,713 | 5/1974 | Joiner | 416/205 |
| 3,907,460 | 9/1975 | Pedersen et al. | 416/139 X |
| 4,046,486 | 9/1977 | Kolb | 416/157 R |
| 4,422,826 | 12/1983 | Casacci et al. | 416/157 R |

FOREIGN PATENT DOCUMENTS

| | | | |
|---|---|---|---|
| 518586 | 2/1931 | Fed. Rep. of Germany | 416/147 |
| 23709 | 2/1977 | Japan | 416/205 |
| 96397 | 7/1980 | Japan | 416/205 |
| 301113 | 11/1954 | Switzerland | 415/130 |
| 569867 | 12/1945 | United Kingdom | 416/147 |

*Primary Examiner*—Everette A. Powell, Jr.
*Attorney, Agent, or Firm*—Sughrue, Mion, Zinn, Macpeak and Seas

[57] ABSTRACT

Axial flow fan blade roots (1) are rotatably journalled to blade shafts (4) by bayonet plug and socket couplings. The socket recesses (30, 31) provide an axial play for the plug cam portions (28, 29). Screws (34, 35) extending through the blade root (1) have shoulders (43) abutting spring members arranged between the root and the shaft to thus bias the blade outwardly and establish frictional engagement between the bayonet coupling cam portions and recesses.

4 Claims, 7 Drawing Figures

SPRING BIASED BAYONET COUPLING FOR FAN BLADES

The invention relates to a blade with a blade shaft for an impeller of an axial flow fan, said impeller having a wheel rim, in which a number of blades are rotatably journalled each with a blade root connected with the blade shaft, the blade shaft being connected inside the wheel rim with a common adjusting device for turning all the blades around the axes of the blades and blade shafts during rotation of the impeller.

From DK-C-131,829, a blade suspension arrangement of the above mentioned kind for axial flow fan impellers is known, in which a threaded bore in the blade root of each blade is screwed onto an associated threaded part of the blade shaft. In order to remedy the disadvantage of prior constructions that the thread in the bore of the blade root and on the blade shaft must be formed as a tightly fitting thread in order to take up radial forces, the blade shaft is formed in this known construction with fit portions inwardly and outwardly of the threaded part in connection with corresponding fit bores in the blade root. Thereby, the thread is only required to take up the centrifugal force directed in the axial direction and may, therefore, be formed as a less tightly fitting thread for the purpose of facilitating unscrewing and screwing-up of the blade relative to the blade shaft and, thereby, replacement of the blade.

Even if the construction according to the above mentioned patent specification has remedied some of the problems with prior blade suspension arrangements, the rather significant axial length of the thread connection between the blade root and the blade shaft still implies that unscrewing and mounting of the blade is a relatively difficult and time-consuming work. Moreover, for heavy blades, the thread connection between the blade root and the blade shaft has the disadvantage that the thread may easily be damaged by impact or shock and is, in addition, exposed to tearing loads if the heavy blade is not kept accurately coaxially centered relative to the blade shaft at mounting and dismounting, which may be difficult due to the conditions of place, under which the work is performed.

By means of the invention, these disadvantages are remedied to a full extent with a simple and sturdy construction, which according to the invention is characterized in that the blade and the blade shaft are connected by bayonet engagement between these two elements, whereby a part of one element forming a bayonet plug member has at least one pair of opposed cam portions at a distance from its external end, which forms a smooth guide portion, said cam portions being adapted for engagement with recesses formed in a bore in a part of the other element forming a bayonet socket member and extending between a bottom portion serving as a fit bore for said smooth guide portion and a pair of opposed internally projecting shoulder portions, said recesses being formed with a play in the axial direction relative to the axial length of the cam portions of the bayonet plug member, at least two fixation screws extending from the external side of the blade root through threaded bores in the wall of the blade root for insertion of their ends forming smooth guide portions into fit bores in a centering portion of the blade shaft and having inwards relative to said guide portions a shoulder portion for abutment against a spring member arranged between the blade root and the side of said centering portion facing the blade root.

From U.S. patent application Ser. No. 821,534, a propeller is known having a simple bayonet engagement between propeller blades which are replaceable during standstill, and bores in a solid hub, flanges on the bayonet plug member connected with the propeller blade being able to get into engagement behind corresponding flanges in the hub bore and be secured in that engagement by means of locking screws screwed-in in the lateral direction.

When assembling the blade and the blade shaft according to the invention, the blade is arranged quickly and without difficulty on the blade shaft and is turned to bayonet engagement between the cam portions of the bayonet plug member and the recesses in the bore of the bayonet socket member due to the axial play between these parts. By subsequent tightening of the two fixation screws, the spring members arranged between the blade root and the centering portion, said spring members being, for instance, disc springs, will provide the necessary force to press the blade root and the blade outwardly for frictional engagement between the cam portions and opposed friction surfaces in the recesses.

As explained in the following, the blade suspension arrangement according to the invention may to a full extent take up the forces acting on the blade during standstill and rotation, as well as starting of the axial flow fan impeller.

Moreover, the design according to the invention implies the particular advantage that the blade root and the blade shaft may be formed from materials having different thermal coefficients of expansion, so that the joint is stable against temperature influences.

A preferred embodiment suitable, in particular, for heavy blades is further characterized in that said bayonet plug member is formed by the external end of the blade shaft and said bayonet socket member of the blade root, said centering portion of the blade shaft being constituted by a flange portion formed as a smooth guide portion on the side thereof facing the blade root, the bore of the blade root being formed at its opening as a fit bore for said guide portion.

The bayonet engagement characteristic of the invention may also be realized in that said bayonet plug member is formed by a blade pin formed on the blade root, and said bayonet socket member of an end portion of the blade shaft, said end portion forming, in addition, said centering portion and being formed at its external side as a smooth guide portion for insertion into a fit bore in the blade root around said blade pin.

These designs having guide portions or fit parts arranged on both sides of the bayonet engagement parts secure a very effective taking-up of bending moments and transverse forces acting on the blade during starting and rotation of the impeller as a result of the inertia of the blade, as well as the buoyancy and centrifugal forces. During mounting, it moreover secures that the blade root is centered accurately coaxially relative to the blade shaft.

In contradistinction to the relatively complicated design with eccentric fit portions known from the above mentioned DK-specification, an accurate angular arrangement of the blade of the blade shaft may be accomplished in a simple way according to the invention in that the threaded bores formed in the wall of the blade root to receive said fixation screws and said fit bores in the centering portion of the blade shaft are positioned unsymmetrically relative to the axis of the blade root and the blade shaft.

In the following, the invention will be further explained with reference to the drawings, in which FIG. 1 is an axial sectional view of a part of an axial flow fan impeller with an embodiment of a blade with a blade shaft according to the invention;

Figure 1:
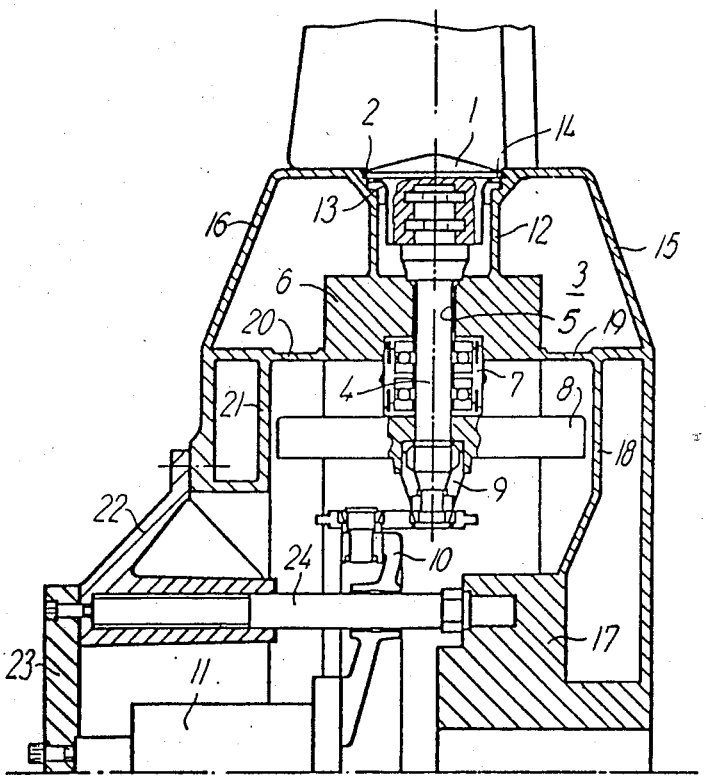

The axial sectional view in FIG. 1 shows the construction of a blade with a blade shaft and the suspension arrangement for a single blade, which is not illustrated and may be of a conventional design. In practice, in case of great impeller diameters, the impeller will have a considerable number of blades.

The blades are rotatably journalled, each with its blade root 1, in openings 2 in a wheel rim designated in its entirety with 3. By means of a bayonet engagement, the more detailed design of which is explained in the following, the blade root 1 is secured on the external end of a blade shaft 4 extending through a bore 5 in an annular body of revolution 6 positioned inside the blade root 1 and serving as a supporting body for the blades. At the opening of the bore 5 at the internal side of the body of revolution 6, the blade shaft 4 is rotatably journalled relative to the body of revolution 6 by means of a thrust bearing 7.

The bearing 7 may be designed as shown as a double bearing of the kind disclosed in International Patent Application No. PCT/DK80/00003 (WO 80/01503).

Inside the bearing 7, a pair of balancing arms 8 are secured to the blade shaft 4, and at its internal end the blade shaft 4 is connected through a control arm 9 with an adjusting disc 10, which is rotatable together with the impeller, but axially displaceable relative thereto and may be caused by means, for example, of a control force provided by a hydraulic cylinder 11 to perform an axial movement for simultaneous changing of the pitch of all the blades.

In the wheel rim 3, the openings for the blade roots 1 are defined by short tubular members 12 which are secured by welding to the external side of the body of revolution 6. At the external opening of each of these tubular pieces 12, a guide 13 matching a flange portion 14 on the blade root is provided.

At the external side, the tubular pieces 12 are, moreover, connected with shell parts 15 and 16 forming the outer circumference of the wheel rim 3 and, thereby, of the impeller.

A hub member 17 designed to be secured on a non-illustrated drive shaft is connected through a body plate 18 and a tubular connecting piece 19 with one side of the body of revolution 6 at the transition to the internal circumference thereof. On the opposite side, the body of revolution 6 is connected through another tubular connecting piece 20 with a front plate 21, to which an annular cover 22 is secured by means of bolts. Moreover, a control cover 23 is secured by means of bolts to the annular cover 22. By removal of these covers, access may be obtained to the interior of the impeller with a blade adjusting mechanism and the thrust bearings of the blade suspension arrangements.

A number of catch members 24 for the blade adjusting mechanism is secured in one end in the hub member 17 and connected in the other end with the covers 22 and 23.

Figure 2:
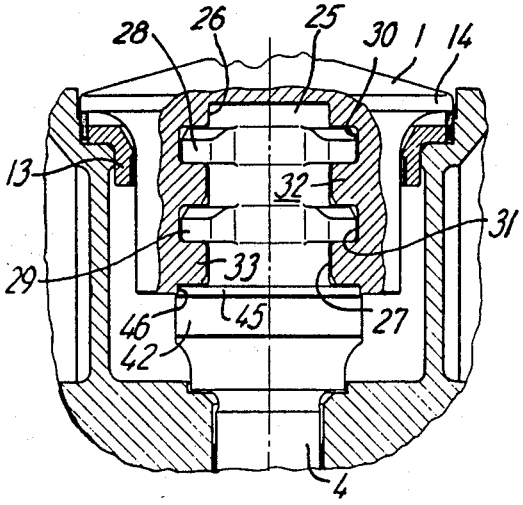
FIG. 2 shows an extract part of FIG. 1 at a greater scale.
Figure 3:
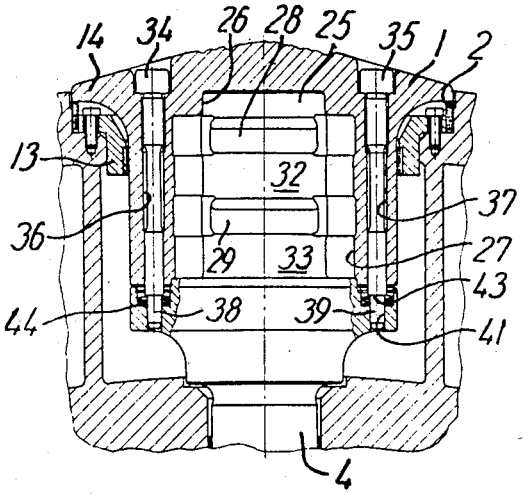
FIG. 3 is an axial sectional view of a part of the blade and the blade shaft in a direction normal to the sectional view in FIG. 2.

As shown in the extracted views in FIGS. 2 and 3, the connection between the blade root 1 and the blade shaft 4 is designed in the embodiment shown in such a way that the external end 25 of the blade shaft 4 is formed in a manner known per se from the above mentioned DK-specification No. 131,829 as a smooth guide portion matching a fit bore 26 formed by a bottom portion of a bore 27 in the blade root. Inside of the guide portion 25, the blade shaft 4 has two pairs of opposed cam portions 28 and 29 for bayonet engagement with recesses 30 and 31 formed in the bore 27 of the blade root 2 between the bottom portion of the bore serving as a fit bore 26 for the guide portion 25 and a first pair of opposed internally projecting shoulder portions 32, on one hand, and between said shoulder portions and a further pair of shoulder portions 33, on the other hand. In the axial direction of the blade root 1, each of the axially displaced recesses 30 and 31 is formed with a play relative to the axial length of the corresponding cam portion 28 and 29, respectively, of the blade shaft 4.

Furthermore, two fixation screws 34 and 35, which in the embodiment shown extend from the external side of the blade root 1 through threaded bores 36 and 37 in the wall of the blade root 1 in an axial plane, are formed at their ends as smooth guide portions 38 and 39 for insertion into fit bores 40 and 41 in a flange portion 42 of the blade shaft 4. Inside of the guide portions 38 and 39, each of the fixation screws 34 and 35 has a shoulder portion 43 for abutment against a spring member 44 in the form of a disc spring, which is arranged between the blade root 1 and the external side of the flange portion 42 of the blade shaft 4 facing the blade root in a cut-out around the corresponding fit bore 40 or 41.

In order to achieve an accurate angular positioning of the blade at the arrangement of the blade root 1 on the blade shaft 4, the threaded bores 36 and 37 in the wall of the blade 1 and the fit bores 40 and 41 in the flange portion 42 of the blade shaft 4 are designed so as to be positioned unsymmetrically relative to the axis of the blade root 1 and the blade shaft 4. In the embodiment shown, this unsymmetric relationship is obtained in a simple manner in that the threaded bores 36 and 37 and the fit bores 40 and 41 are positioned at unequal distances from the axis, but in the same axial plane. The difference between said distances may be quite small, such as 2–3 mms.

In order to secure an efficient taking-up of the bending moments and transverse forces mentioned in the following, which act on the blade during starting and rotation of the impeller and, moreover, secure an accurate coaxial centering of the blade root relative to the blade shaft, the flange portion 42 of the blade shaft 4 is designed with a smooth guide portion 45 at the side facing the blade root 1, and the bore 27 of the blade root 1 is formed at its opening with a fit bore 46 for this guide portion 45.

During starting and rotation of the impeller, the joint between the blade root 1 and the blade shaft 4 is exposed to loads caused by the centrifugal force, the reaction or air force acting on the blade and the inertia of the blade.

As a result of the geometrical configuration of the blade and the blade pitch relative to the rotational plane, the centrifugal force implies, in addition to a normal force acting in the axial direction of the blade root 1 and the blade shaft 4, a bending moment on the blade and a torque around the axis as well as transverse force. Out of these loads, the normal force and the torque will be taken up and transferred to the blade shaft 4 due to the above mentioned frictional engagement between the shoulder portions 32 and 33 in the bore 27 of the blade root 1 and the cam portions 28 and 29 of the blade shaft 4. The bending moment and the transverse force will be taken up by the cylindrical fits on each side of the engaging parts of the blade root 1 and the blade shaft 4.

During rotation of the impeller, the reaction or air force acts on each blade in a direction normal to the direction of the incoming air flow and causes, thereby, a bending moment which, as mentioned above, will be taken up by the cylindrical fits, as well as a torque and a transverse force which are taken up by the frictional engagement.

Finally, during starting, the inertia of the blade will cause a bending moment which is taken up by the cylindrical fits between the guide portions 25 and 45 on the blade shaft 4 and the flange portion 42 thereof and the corresponding fit bores 26 and 46, respectively, at the bottom and the opening of the bore 27 of the blade root 1.

Figure 6:
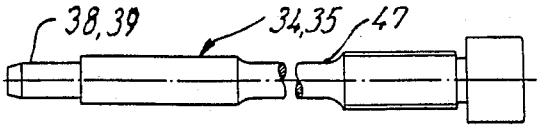
FIG. 6 is an enlarged view of a fixation screw in the embodiment in FIGS. 1 to 3.

As apparent in particular from FIG. 6, the fixation screws 34 and 35 have a portion 47 with a reduced cross section. This design serves to limit the axial movement of the fixation screws by engagement between the portion 47 of reduced cross section and a non-illustrated blocking screw in the wall of the blade root 1, such as known per se from the above mentioned DK-specification No. 131,829.

As will be apparent, the joint between the blade root and the blade shaft obtained by the invention implies that dismounting of a blade may be performed without interference with the interior of the impeller, since it is only necessary to loosen the fixation screws 34 and 35 and subsequently turn the blade around its axis ti release the bayonet engagement between the cam portions 28, 29 and the recesses 30 and 31.

Figure 7:
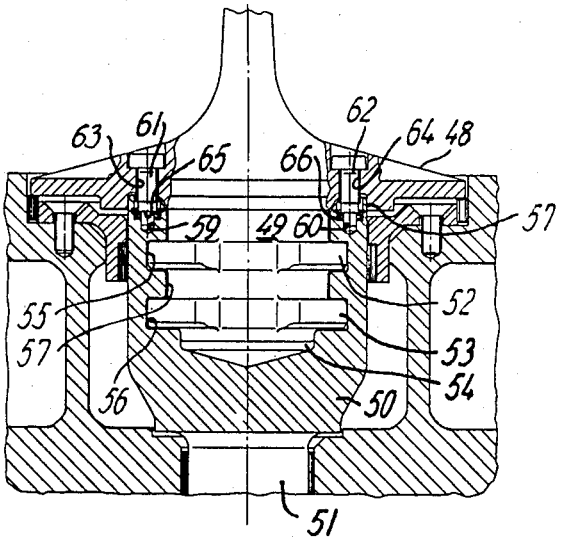
FIG. 7 is a view corresponding to FIGS. 2 and 3 of another embodiment.
Figure 4:
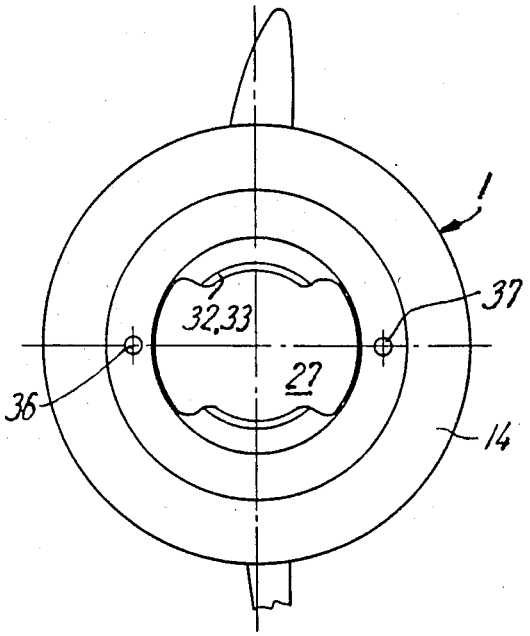
FIGS. 4 and 5 are views from the ends of the blade and the blade shaft, respectively, of the embodiment in FIGS. 1 to 3.
Figure 5:
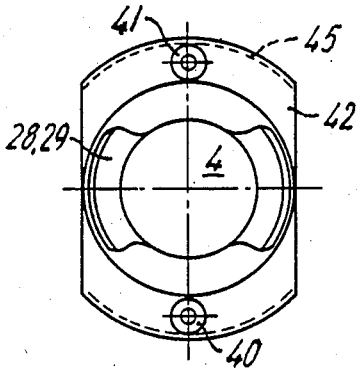

In the embodiment shown in FIG. 7, the bayonet engagement between the blade and the blade shaft has been inversed relative to the embodiment shown in FIGS. 1 to 3, since the bayonet plug member is formed by a blade pin 49 formed on the blade root 48 and the bayonet socket member of an end portion 50 of the blade shaft 51. The engagement as such, involving cam portions 52 and 53 at a distance from the end 54 of the blade pin 49 forming smooth guide portions, and recesses 55 and 56 in a bore 57 in the end portion 50 of the blade shaft 51 is constructed in the same way as in the embodiment described in the foregoing.

In FIG. 7, the centering portion of the blade shaft 51 is formed by the above mentioned end portion 50 which is formed at its external side as a smooth guide portion for insertion into a bore 58 in the blade root 48 around the blade pin 49 and is formed in the annular end face around the bore 57 with fit bores 59 and 60 to receive the ends of fixation screws 61 and 62 forming smooth guide portions, the fixation screws extending through threaded bores 63 and 64 in the blade root 48 and having inside the guide portions a shoulder portion 65 for abutment against a spring member 66 in the form of a disc spring.

With this design of the outer fit between the blade and the blade shaft at the bore 58 and the external side of the end portion 50, the additional advantage is obtained that extension or opening of the bore 57 in the blade shaft towards an increased diameter resulting from severe load conditions will be prevented.

The embodiments shown and described are not limiting for the invention. Thus, dependent on dimensions and load, it will in many cases be sufficient with a bayonet-engagement between one pair of cam portions on the bayonet plug member, and one pair of corresponding recesses in the bayonet socket member, which will in particular be an advantage if the blade root and the blade shaft are made of materials having different thermal coefficient of expansion.

In addition, as a result of the very sturdy construction of the joint, it is not strictly necessary in all cases that cylindrical fits are present at both sides of the engaging parts, even if this is usually to be preferred.

Moreover, a correct angular positioning in the mounting of the blade may be obtained in another way than by means of the described unsymmetric relationship of the threaded bores 36, 37 and the fit bores 40, 41 for the fixation screws 34, 35. The unsymmetric relationship may as such also be obtained in a different manner than through the described unequal distances from the axis, even if this solution is preferred due to its simplicity.

We claim:

1. A blade with a blade shaft (4) for an impeller of an axial flow fan, said impeller having a wheel rim (3), in which a number af blades are rotatably journalled each with a blade root (1; 48) connected with the blade shaft (4), the blade shaft being connected inside the wheel rim with a common adjusting device (10) for turning all the blades around the axes of the blades and blade shafts during rotation of the impeller, characterized in that the blade and the blade shaft (4; 51) are connected by bayonet engagement between these two elements, whereby a part (4; 49) of one element forming a bayonet plug member has at least one pair of opposed cam portions (28, 29; 52, 53) at a distance from its external end, which forms a smooth guide portion (25; 54), said cam portions being adapted for engagement with recesses (30, 31; 55, 56) formed in a bore (27; 57) in a part (1; 50) of the other element forming a bayonet socket member and extending between a bottom portion serving as a fit bore (26) for said smooth guide portion (25; 57) and a pair of opposed internally projecting shoulder portions (32, 33), said recesses (30, 31; 55,56) being formed with a play in the axial direction relative to the axial length of the cam portions (28, 29; 52, 53) of the bayonet plug member, at least two fixation screws (34, 35; 61, 62) extending from the external side of the blade root (1) through threaded bores (36, 37; 63, 64) in the wall of the blade root (1; 48) for insertion of their ends forming smooth guide portions (38, 39) into fit bores (40, 41; 59, 60) in a centering portion (42; 50) of the blade shaft (4) and having inwards relative to said guide portions (38, 39; 59, 60) a shoulder portion (43; 65) for abutment against a spring member (44; 66) arranged between the blade root (1; 48) and the side of said centering portion (42; 50) facing the blade root.

2. A blade with a blade shaft as claimed in claim 1, characterized in that said bayonet plug member is formed by the external end of the blade shaft (4) and said bayonet socket member of the blade root (1), said centering portion of the blade shaft (4) being constituted by a flange portion (42) formed as a smooth guide portion (45) on the side thereof facing the blade root (1), the bore (27) of the blade root (1) being formed at its opening as a fit bore (46) for said guide portion.

3. A blade with a blade shaft as claimed in claim 1, characterized in that said bayonet plug member is formed by a blade pin (49) formed on the blade root (48), and said bayonet socket member of an end portion (50) of the blade shaft (57), said end portion forming, in addition, said centering portion and being formed at its external side as a smooth guide portion for insertion into a fit bore (58) in the blade root (48) around said blade pin (49).

4. A blade with a blade shaft as claimed in any of claims 1, 2 or 3, characterized in that the threaded bores (36, 37) formed in the wall of the blade root (1) to receive said fixation screws (34, 35) and said fit bores (40, 41) in the centering portion (42) of the blade shaft (4) are positioned unsymmetrically relative to the axis of the blade root (1) and the blade shaft (4).

* * * * *